United States Patent [19]

Shiozaki

[11] 4,349,224

[45] Sep. 14, 1982

[54] ANIMAL WASTE COLLECTING AND DISPOSING APPARATUS

[76] Inventor: Ted M. Shiozaki, 5349 N. Meade Ave., Chicago, Ill. 60630

[21] Appl. No.: 160,665

[22] Filed: Jun. 18, 1980

[51] Int. Cl.[3] ..... A01K 29/00

[52] U.S. Cl. ..... 294/1 BA

[58] Field of Search ..... 294/1 B, 1 BA, 1 BB, 294/19 R, 20, 22, 50.8, 50.9, 55; 15/104.8, 257.1, 257.2, 257.3, 257.6, 257.7

[56] References Cited

U.S. PATENT DOCUMENTS

| | | | |
|---|---|---|---|
| 3,744,453 | 7/1973 | Deitch | 294/1 BB |
| 3,810,670 | 5/1974 | Turi | 294/19 R |
| 3,823,970 | 7/1974 | Brenner | 294/1 BA |
| 3,827,098 | 8/1974 | Sanderson | 15/104.8 |
| 3,830,423 | 8/1974 | Prescott | 229/553 |
| 3,977,715 | 8/1976 | Casci | 294/1 BA |
| 4,048,691 | 9/1977 | Spangler | 294/1 BA |
| 4,138,153 | 2/1979 | Brown | 294/1 R |
| 4,146,259 | 3/1979 | Schultz | 294/19 R |
| 4,165,895 | 8/1979 | Bacoka | 294/1 BA |

*Primary Examiner*—James B. Marbert

*Attorney, Agent, or Firm*—Merriam, Marshall & Bicknell

[57] ABSTRACT

Apparatus for collecting and disposing of animal waste, wherein sockets are defined at the working ends of a pair of elongated rods, for respectively receiving and releasably retaining the stem portions of either an open frame, to which a disposable waste collecting bag is connected, or a paddle, which facilitates movement of animal waste into the collecting bag. A depressible push button is provided on the handle portion of each rod, and mechanism in each handle portion acts through linkage extending through the rod to shift a detent in the socket out of engagement with a shoulder on the stem portion of either the frame or paddle. Springs in the sockets of the rods serve to forcefully eject the stem portions of the frame and paddle therefrom when the push buttons are depressed so that the associated frame, waste collecting bag and its contents, and the paddle, are conveniently disposed of after use.

23 Claims, 6 Drawing Figures

ANIMAL WASTE COLLECTING AND DISPOSING APPARATUS

BACKGROUND OF THE INVENTION

This invention relates to apparatus for collecting and disposing of animal waste, and more particularly relates to apparatus for collecting and disposing of animal waste in which a frame for supporting a wste collecting bag, and a paddle for manipulating waste into the bag, are each ejectable from the working ends of a pair of elongated rods for manipulating the frame and paddle after the bag, supporting frame and paddle have served their purpose.

Various types of devices and apparatus have been developed for collecting and disposing of animal wastes. Some of these devices utilized a two-piece construction consisting of a pair of rods, one end of which was provided with a frame for supporting an animal waste receiving bag and the other of which included a paddle or pusher to facilitate collection of the waste in the bag. Examples of animal waste collecting or pick-up devices of the foregoing character are disclosed in the Bacoka U.S. Pat. No. 4,165,895, Turi U.S. Pat. No. 3,810,670, and Sanderson U.S. Pat. No. 3,827,098.

While the pick-up devices disclosed in the aforementioned patents achieve their intended purpose, they have not proved entirely satisfactory for various reasons, including the necessity for the user at some point in the clean-up operation to manually disengage the filled bg from the collecting device and dispose of it in an appropriate receptacle. Moreover, the complexity of construction and manner of use of many of the collecting devices heretofore advanced have also rendered them unsatisfactory to many users.

Accordingly, it is a general object of the present invention to provide a novel and improved apparatus for collecting and disposing of animal waste, which overcomes the aforementioned disadvantages and shortcomings of the prior art devices.

Another object is to provide a novel apparatus of the foregoing character, wherein the user thereof does not have to handle the waste collecting bag after the latter has served its purpose.

A more particular object is to provide a novel apparatus for collecting and disposing of animal waste, in which a frame for supporting a bag for collecting the waste, and a pusher paddle for manipulating the waste into the bag, are each separable from their supporting rods for disposal purposes without being touched by the hands of the user.

A specific object is to provide a novel animal waste collecting and disposing apparatus of the foregoing character, in which a spring-type ejecting mechanism is employed in the ends of the rods which receive the frame and paddle so that a filled bag, its supporting frame and the manipulating paddle may be forcefully ejected into an appropriate waste receptacle without being handled by the user.

These and other objects will become apparent from the detailed description which follows.

BRIEF SUMMARY OF THE INVENTION

Briefly described, the present invention contemplates a pair of elongated rods each having a handle portion at one end and a working end portion at its other end. A socket is provided in the working end portion of each rod, the socket in one of the rods being adapted to receive the stem portion of an open frame to which a disposable waste collecting bag is connected. A plurality of barbs are provided around the periphery of the frame to secure the bag to the frame. The socket in the working end of the other rod is likewise adapted to receive the stem portion of a paddle, which facilitates movement of animal waste into the collecting bag.

Each rod also includes releasable retaining means, which includes a depressible push button in the handle portion, and linkage for translating movement of the push button to a shiftable detent in the socket. The detent in the socket of the one rod is adapted to engage a shoulder on the stem portion of the open frame and the detent in the socket of the other rod is adapted to engage a shoulder on the stem portion of the paddle. Springs in the sockets of the rods serve to forcefully eject the stem portions therefrom so that the associated frame, waste collecting bag and its contents, and the paddle, are conveniently disposed of after use.

DETAILED DESCRIPTION

Figure 1:
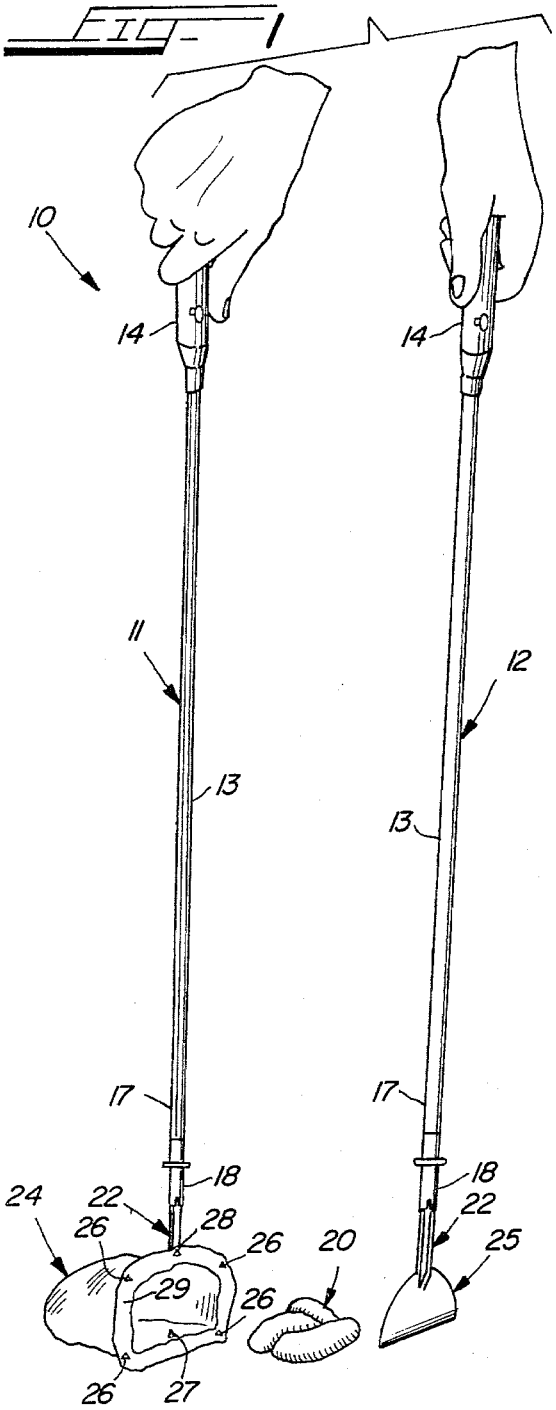
FIG. 1 is a perspective view of the two elongated rods or handles of the present invention and showing the latter as they would appear when the disposable paddle on the working end of one of the rods is being used to push animal waste into a disposable collecting bag that is supported by a disposable frame connected to the working end of the other of the rods.
Figure 2:
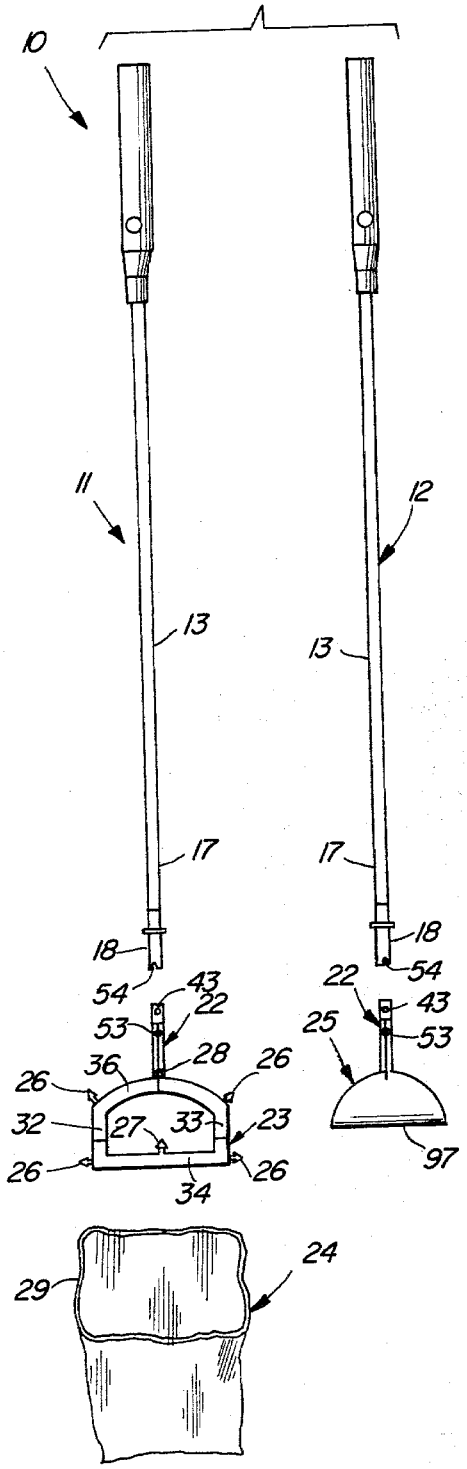
FIG. 2 is an exploded elevational view showing the disposable paddle, disposable frame and a disposable waste collecting bag as they would appear when detached from the working ends of the rods.

In FIGS. 1 and 2, an animal waste collecting and disposing apparatus, embodying the features of the present invention, is illustrated and indicated generally at 10. As will be apparent from these figures, the apparatus 10 comprises first and second elongated handle means in the form of a pair of rods, indicated generally at 11 and 12, respectively. The rods 11 and 12 are substantially identical in construction and may be used interchangeably. Consequently, only the construction of the rod 11 will be described in detail.

In this regard, for the purposes of understanding the structural details and mode of operation of the present invention, the rod 11 will be hereinafter described in conjunction with frame means in the form of an open, bag supporting frame 23 and the rod 12 will be described in conjunction with pusher means in the form of a paddle 25, which facilitates movement of animal waste, indicated at 20, into a bag 24 that is connected to and supported by the frame 23. The frame 23 and paddle 25 are preferably of plastic. The bag 24 may be of any type suitable for receiving and retaining animal waste in an inoffensive manner, and is also preferably of plastic.

Figures 3, 4, 5, 6:
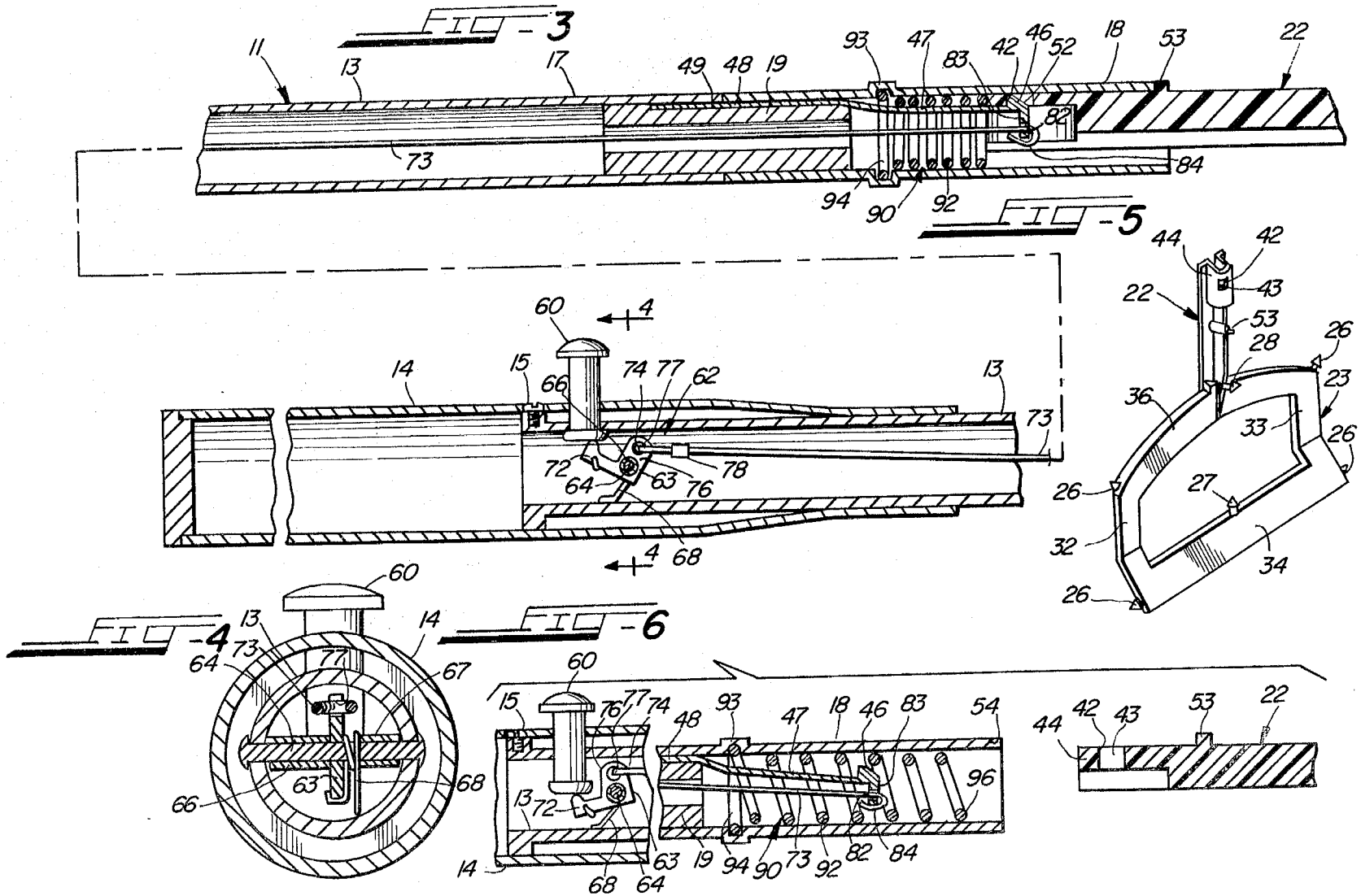
FIG. 3 is an enlarged, broken, longitudinal sectional view through one of the rods of the animal waste collecting and disposing apparatus of the present invention and showing the internal parts thereof.
FIG. 4 is a transverse cross sectional view taken substantially along the line 4—4 of FIG. 3.
FIG. 5 is a perspective view of the disposable frame which supports a disposable waste collecting bag.
FIG. 6 is a broken, fragmentary longitudinal sectional view of portions of the rod illustrated in FIG. 3 and showing the parts thereof in the positions they would occupy after either the bag supporting frame or paddle have been ejected from the end of the rod.

Referring now to FIGS. 3, 4 and 5, in conjunction with FIGS. 1 and 2, it will be seen that the rod 11 includes an elongated, tubular body portion 13 having an enlarged handle portion 14 secured to the upper end thereof as by a screw 15 (FIG. 3), and a lower or working end 17. While the rods 11 and 12 may be of any desired material having the required strength and wear characteristics, they are preferably of cold rolled steel.

As best seen in FIG. 3, the lower end portion 17 of the rod 11 includes a tubular extension 18 which is secured to a bushing 19 as by a screw (not shown), the bushing 19 being secured in the lower end of the body portion 13 of the rod as by another screw (also not shown). The interior of the extension 18 forms a socket for receiving a portion of a stem 22 of the frame 23, which is adapted to receive and retain the bag 24 for collecting animal waste.

In order to secure the open end, indicated at 29, of the bag 24 to the frame 23, a plurality of barbs, each indicated at 26, are provided around the outer periphery of the frame 23, a barb 27 is provided on the inner periphery of the frame, and a forwardly extending barb 28 is provided on the upper portion of the frame 23. Specifically, a laterally outwardly extending barb 26 is provided on the outer periphery of the frame 23 adjacent the upper and lower ends of the laterally spaced, vertically extending side portions, indicated at 32 and 33, respectively, of the frame, the barb 27 extends centrally upwardly from the lower, horizontally extending portion, indicated at 34, of the frame 23, and the forwardly extending barb 28 extends forwardly from the upper, substantially horizontally extending portion, indicated at 36, of the frame. The barbs 26, 27 and 28 are adapted to puncture the material of the bag 24, adjacent the open end 29 after the open end 29 has been inserted through the open area of the frame 23 and folded outwardly around the outer periphery thereof, as illustrated in FIG. 1.

In order to facilitate movement of animal waste material, such as the waste material 20 (FIG. 1), into the bag 24, the lower horizontal portion 34 of the frame 23 is preferably inclined or bent somewhat forwardly from the side portions 32 and 33 to provide a shoveling action when the frame 23 is advanced into contact with a quantity of animal waste to be collected.

According to the present invention, the tubular extension 18 of the rod 11 includes means for releasably retaining the frame 23 engaged therewith when the apparatus 10 is in use. Such releasable retaining means includes a shoulder 42 provided by an opening 43 in the upper or distal end, indicated at 44, of the stem 22, and a detent 46 at one end of an elongated, flexible arm 47 and shiftable into and out of engagement with the shoulder 42. The arm 47 extends lengthwise of the body portion 13 of the rod 11 and a portion 48 thereof opposite from the detent 46 is preferably received and secured in an axially extending recess 49 in the outer periphery of the bushing 19. Such a securement may be by welding, soldering or a threaded fastener.

In order to facilitate movement of the detent 46 into the opening 43 in the stem 22 as the stem 22 is moving inwardly in the extension 18 toward its fully inserted, operating position, the outwardly facing surface, indicated at 52 in FIG. 3, of the detent 46 is preferably beveled. The beveled surface 52 thus acts as a cam and causes the detent to shift inwardly during insertion of the stem 22 into the extension 18. In this regard, while the detent 46 may be formed as a solid piece of material, it is conveniently formed by laterally outwardly extending portions of the material of the flexible arm 47, which are bent upwardly. Thus, the detent is preferably U-shaped in transverse cross section.

In order to assure accurate alignment of the detent 46 with the opening 43 in the stem 22 when the stem is in its operating position in the extension 18, the stem is provided with a lug 53, which is adapted to extend into a groove 54 (FIGS. 1 and 2) in the remote lower end of the extension 18. Thus, as the stem 22 approaches its operating position in the extension 18, a user need only make sure that the lug 53 is fully seated in the groove 54 to assure correct alignment of the parts. When the stem 22 reaches its fully inserted, operating position in the extension 18, the detent 46 will snap into the opening 43 and secure the stem 22, and consequently the frame 23 and a waste collecting bag 24, in the extension 18 of the lower end portion 17.

In order to release the stem 22 from the lower end portion 17 of the rod, the handle portion 14 includes manually actuated means in the form of a depressible push button 60 for effecting movement of the detent 46 out of the opening 43 in the stem 22 so that the latter can shift axially outwardly out of the extension 18. To this end, mechanism, indicated generally at 62, is provided in the handle portion 14 of the rod for translating inward movement of the push button 60 into inward movement of the detent 46. The construction of the mechanism 62 for this purpose, will now be described.

Referring now to FIG. 6 in conjunction with FIGS. 3 and 4, it will be seen that the mechanism 62 comprises a bell crank 63 mounted for pivotal movement on a shaft 64 extending transversely of the body portion 13 of the rod within the enlarged handle portion 14. Spacer sleeves 66 and 67 are mounted on the shaft 64 on opposite sides of the bell crank 63 and prevent lateral shifting of the crank on the shaft. A torsion spring 68 is mounted on the shaft 64 and serves to bias one of the arms 72 of the crank 63 into engagement with the inner end of the push button 60. Consequently, an outwardly biasing force is constantly applied to the inner end of the push button 60.

Linkage in the form of an elongated member, preferably a length of wire 73, is connected at one end 74 to the other arm, indicated at 76, of the crank 63, such as by extending the end 74 through an opening 77 in the arm 76 and therafter forming the end 74 into a loop and securing the free end of the loop to the remainder of the wire 73 in any convenient manner. A connector, indicated at 78, is illustrated in FIG. 3 for this purpose.

The wire 73 extends from the bell crank 63 through the tubular body portion 13 of the rod 11, through the bushing 19 and through an opening 82 (FIG. 3) in a depending finger 83 on the outer end of the flexible arm 47. The portion of the wire 73 which extends through the opening 82, is bent into a loop 84 to thus secure the wire 73 to the finger 83. Consequently, when the push button 60 is depressed, the arm 76 of the mechanism 62 pulls on the wire 73 and causes inward flexure of the arm 47. Such movement shifts the detent 46 out of the opening 43 in the stem 22 of the frame 23, thereby disengaging the stem 22, and consequently the frame 23, from the extension 18 of the working end portion 17 of the rod 11. The frame 23, together with a waste collecting bag 24, and its contents, may then be conveniently disposed of in an appropriate waste receptacle. FIG. 6 illustrates the positions of the push button 60, bell crank 63, flexible arm 47 and detent 46 when the push button 60 has been depressed sufficiently to disengage the detent 46 from the shoulder 42 on the stem 22.

According to the present invention, the rod 11 includes means, indicated generally at 90, for forcefully ejecting the stem 22 of the frame 23, and consequently the collecting bag 24 and its contents, from the working end 17 of the rod 11 after the bag has been filled and is ready for disposal. Such means preferably comprises a coil spring 92 mounted in the inner end of the tubular extension 18 or socket. To this end, the tubular extension 18 includes a radially enlarged portion 93 comprising a seat that is adapted to receive and retain the innermost coil, indicated at 94, of the spring 92. The other coils of the spring 92 are sized to closely fit the inner periphery of the tubular extension 18 and to surround the flexible arm 47 and detent 46. The unstressed length of the spring 92 is such that the outermost coil, indicated at 96, of the spring extends substantially beyond the detent 46, as shown in FIG. 6. Consequently, when the distal end 44 of the stem 22 is inserted into the open end of the tubular extension 18, the spring 92 will be compressed and exert an outward force on the stem 22 tending to forcefully eject the stem from the tubular extension 18. However, when the detent 46 is engaged with the shoulder 42, as shown in FIG. 3, the stem 22, and consequently the frame 23 and collecting bag 24 will be retained in the working end portion 17 of the rod 11 until the push button 60 is depressed. When this occurs, the detent 46 is shifted out of engagement with the shoulder 42 and the spring 92 forcefully ejects the stem portion 22, along with the frame 23 and waste collecting bag 24, from the working end 17 of the rod. FIG. 6 illustrates the latter condition.

As previously mentioned, the construction of the second handle means or rod 12 is indentical with that of the first handle means or rod 11. Consequently, no further description of the rod 12 is necessary or will be included. The rod 12 of the apparatus 10 differs from the rod 11 in that, instead of having a frame engaged with the socket or tubular extension 18 thereof, the rod 12 is adapted to receive and releasably retain the stem portion 22 of the paddle 25. While the paddle 25 is preferably semi-circular in shape with the stem 22 extending outwardly from the convex edge thereof and perpendicularly to the straight, lower edge, indicated at 97, the pusher 25 could also have different shapes, such as triangular or rectangular.

The pusher 25 is engageable with the working end portion 17 of the rod 12 and disengageable therefrom in the same manner that the frame 23 is engageable with and disengageable from the extension 18 or socket of the rod 11.

In the use of the apparatus 10, prior to the time that animal waste is to be collected and disposed of, a user of the apparatus will initially engage a disposable bag, such as the bag 24 illustrated in FIG. 2, with the frame 23 by inserting the bag into the open interior of the frame 123 and then folding the upper edge 29 thereof outwardly and around the frame until the barbs 26, 27 and 28 perforate the margin of the bag and secure the same to the frame 23.

Thereafter, the stem portion 22 of the frame 23, with the bag 24 attached thereto, is inserted into the open lower end of the extension 18 until the detent 46 snaps into the opening 43 in the upper end of the stem 22. The inner edge 42 of the opening 43 defines a shoulder against which the detent bears to retain the stem portion 22, and the frame 23, secured in its operating position in the tubular extension 18 of the rod 11. As the stem 22 of the frame 23 is shifted into the extension 18, the spring 92 is compressed, thereby storing energy in the spring 92 to forcefully eject the stem 22, along with the frame 23, the attached bag 24 and any contents therein, from the end of the rod 11.

Disengagement of the stem 22 from the lower end 17 of the rod 11 is effected by depression of the push button 60 on the handle portion 14 of the rod. Such movement causes the bell crank 63 (FIG. 3) to move in a counterclockwise direction against the force of the torsion spring 68 to the position thereof illustrated in FIG. 6. Such movement causes the wire 73, which is connected to the arm 76 of the crank 63, to pull the flexible arm 47 inwardly, thereby withdrawing the detent 46 from the opening 43 in the stem 22. When this occurs, the stored energy in the spring 92 forcefully ejects the stem 22, along with the frame 23, the attached bag 24 and its contents, out of the lower tubular extension 18 of the rod 11. Prior to depressing the button 60, it is assumed that the user will direct the frame 23, bag 24 and its contents into an appropriate receptacle.

Thereafter, the rod 12 with the attached paddle 25 is positioned near the same receptacle and the push button 60 thereof depressed. When this occurs, the detent 46 of the rod 12 is likewise withdrawn from the opening 43 in the stem portion 22 of the paddle 25 and the compressed force of the spring 92 in the tubular extension 18 forcefully ejects the paddle 25 into the same receptacle in which the frame 23 and bag 24 were placed. A user may then immediately engage another bag 24 with another frame 23 and insert the stem 22 thereof into the rod 11 in readiness for another waste collecting and disposing operation. The stem 22 of another paddle 25 may also then be inserted into the tubular extension 18 of the rod 12, for coaction with the frame 23 and bag 24 during the next waste collecting operation. Alternately, the foregoing operations can be deferred until there is again a need to collect and dispose of animal waste.

While only one embodiment of the invention has been herein illustrated and described in detail, it will be understood that modifications and variations thereof may be developed which do not depart from the spirit of the invention and the scope of the appended claims.

I claim:

1. Apparatus for collecting and disposing of animal waste comprising elongated handle means having a handle portion and a working end portion, said working end portion having a socket, frame means carried at said working end portion and having a stem insertable into said socket, said frame means being adapted to receive and retain a bag for collecting animal waste, means coacting with said stem for releasably retaining the latter engaged with the socket in said working end portion of said handle means, and ejecting means in said working end portion for ejecting the stem of said frame means from said socket when said releasable retaining means releases said stem, whereby said frame means, said collecting bag and its contents can be simultaneously disengaged and ejected from said working end portion so that a user of said apparatus does not have to touch said frame means or said collecting bag in order to dispose of the same after use.

2. The apparatus of claim 1, in which said ejecting means includes spring means mounted in said socket and compressed by the stem of said frame means when said stem is shifted to an operating position in said socket, said spring means being operable to eject said stem from said socket along with said frame means and an attached waste collecting bag when said releasable retaining means releases said stem.

3. The apparatus of claim 2, in which a seat is provided in the bottom of said socket, and said spring means comprises a coil spring having an inner end coil seated in said seat and an outer end coil engageable with said stem.

4. In an apparatus for collecting and disposing of animal waste, said apparatus including first elongated handle means having a handle portion and a working end portion, the improvement of frame means adapted to be carried by the working end portion of said first elongated handle means and adapted to receive and support a waste collecting bag, said frame means comprising a generally rectangular open frame having barb means adapted to puncture said bag and retain the same engaged with said frame so that said bag and any contents therein can be disposed of with said frame.

5. The improvement of claim 4, in which said frame includes laterally spaced, vertically extending side portions and vertically spaced, substantially horizontally extending portions connecting the upper and lower ends of said side portions, and said barb means includes a plurality of barbs at least on the outer periphery of said frame.

6. The improvement of claim 5, in which said barb means includes a laterally outwardly extending barb on the outer periphery of said frame substantially adjacent to the upper and lower ends of each of said side portions.

7. The improvement of claim 6, in which the lower horizontally portion of said frame has upper and lower edges, and an upwardly extending barb is provided on the upper edge of the lower, horizontally extending portion of said frame.

8. The improvement of claim 7, in which said frame has front and rear sides, and a forwardly extending barb is provided on the front side of the upper, substantially horizontally extending portion of said frame.

9. Apparatus for collecting and disposing of animal waste comprising first elongated handle means having a handle portion and a working end portion, frame means adapted to receive and retain a bag for collecting animal waste, said first handle means also having means therein for releasably retaining said frame means engaged with the working end portion thereof, said first handle means further having spring means therein for forcefully ejecting said frame means and an attached waste collecting bag from said working end portion, manually actuated means carried by the handle portion of said first handle means for causing said releasable retaining means to release said frame means so that the latter and an attached waste collecting bag are ejected from the working end portion of said first handle means by said spring means, second elongated handle means having a handle portion and a working end portion, pusher means adapted to engage and shift animal waste into a waste collecting bag attached to the frame means at the working end portion of said first handle means, said second handle means also having means therein for releasably retaining said pusher means engaged with the working end portion thereof, said second handle means further having spring means for forcefully ejecting said pusher means from said working end portion, and manually actuated means carried by the handle portion of said second handle means for causing said releasable retaining means to release said pusher means so that the latter is ejected from the working end portion of said second handle means by said spring means, whereby a user of said apparatus may dispose of said frame means and a used waste collecting bag by actuating the manually actuated means on the handle portion of said first handle means and may dispose of said pusher means by actuating the manually actuated means on the handle portion of said second handle means.

10. Apparatus for facilitating the collection and disposal of animal waste comprising elongated handle means having a handle portion and a working end portion, said working end portion having a socket, pusher means carried at said working end portion and having a stem insertable into said socket, said pusher means being adapted to facilitate movement of animal waste into a bag or the like for collecting the same, means coacting with said stem for releasably retaining the latter engaged with the socket in said working end portion of said handle means, and ejecting means in said working end portion for ejecting the stem of said pusher means from said socket along with said pusher means when said releasable retaining means releases said stem, whereby a user can disengage said pusher means from said working end portion after use without touching the same.

11. The apparatus of claim 10, in which said pusher means comprises a paddle.

12. The apparatus of claim 10, in which said ejecting means comprises spring means mounted in said socket and adapted to be engaged and compressed by the stem of said pusher means when said stem is shifted to an operating position in said socket.

13. The apparatus of claim 12, in which a seat is provided in the bottom of said socket, and said spring means comprises a coil spring having an inner end coil seated in said seat and an outer end coil engageable with said stem.

14. Apparatus for facilitating the collection and disposal of animal waste comprising elongated handle means having a handle portion and a working end portion having a socket, pusher means carried at said working end portion and having a stem insertable into said socket, said stem having means defining a shoulder thereon, said working end portion having a flexible arm mounted therein and a detent on the free end of said arm engageable with said shoulder, said arm normally biasing said detent into engagement with said shoulder so as to hold said stem in an operating position in said socket, said handle portion having manually actuated means, and mechanism connecting said manually actuated means with said detent, said manually actuated means being operable when actuated to effect movement of said detent in a direction to effect disengagement thereof from the shoulder on said stem, whereby a user can disengage said pusher means from said working end portion after use without touching the same.

15. The apparatus of claim 14, in which said manually actuated means comprises a depressible push button.

16. The apparatus of claim 15, in which said detent holds said stem in an operating position in said socket when engaged with said shoulder, and said push button is operable when depressed to cause flexure of said arm and movement of said detent in said direction to effect disengagement of said detent from said shoulder.

17. The apparatus of claim 16, in which said mechanism includes a crank mounted for pivotal movement in said handle portion and having a pair of diverging arms, one of said arms engaging said push button and the other of said arms effecting movement of said flexible arm.

18. The apparatus of claim 17, in which an elongated member extends through said handle means and connects said flexible arm with said other arm of said crank.

19. The apparatus of claim 18, in which said elongated member comprises a length of wire.

20. Apparatus for collecting and disposing of animal waste comprising elongated handle means having a handle portion and a working end portion, said working end portion having a socket, frame means carried at said working end portion and having a stem insertable into said socket, said stem having means defining a shoulder thereon, said working end portion also having a flexible arm mounted therein and a detent on the free end of said arm engageable with said shoulder, said arm normally biasing said detent into engagement with said shoulder so as to hold said stem in an operating position in said socket, said handle portion having a manually depressible push button, and mechanism connecting said push button with said detent, said push button being operable when depressed to cause flexure of said arm and movement of said detent in a direction to effect disengagement thereof from the shoulder on said stem, whereby said frame means, said collecting bag and its contents can be simultaneously disengaged from said working end portion so that a user of said apparatus does not have to touch said frame means or said collecting bag in order to dispose of the same after use.

21. The apparatus of claim 20, in which said mechanism includes a crank mounted for pivotal movement in said handle portion and having a pair of diverging arms, one of said arms engaging said push button and the other of said arms effecting movement of said flexible arm.

22. The apparatus of claim 21, in which an elongated member extends through said first handle means and connects said flexible arm with said other arm of said crank.

23. The apparatus of claim 22, in which said elongated member comprises a length of wire.

* * * * *